United States Patent [19]

Laurie

[11] 4,044,173

[45] Aug. 23, 1977

[54] ELECTRICAL RESISTANCE COMPOSITIONS

[75] Inventor: Alexander S. Laurie, Horsham, England

[73] Assignee: E. R. A. Patents Limited, Leatherhead, England

[21] Appl. No.: 519,717

[22] Filed: Oct. 31, 1974

Related U.S. Application Data

[63] Continuation-in-part of Ser. No. 249,804, May 3, 1972, abandoned.

[51] Int. Cl.[2] ..... H01B 1/06; B05D 5/12

[52] U.S. Cl. ..... 427/101; 427/123; 427/126; 427/376 A; 427/376 C; 252/518

[58] Field of Search ..... 252/518, 512, 513, 514, 252/518.1; 106/47 R; 117/201; 427/101, 102, 103, 126, 123, 376 A, 376 C

[56] References Cited

U.S. PATENT DOCUMENTS

| | | | |
|---|---|---|---|
| 2,891,914 | 6/1959 | Fenity | 252/518 |
| 2,969,582 | 1/1961 | Meredith | 252/512 |
| 3,226,342 | 12/1965 | Kesten | 252/503 |
| 3,379,942 | 4/1968 | Davis | 106/47 R |
| 3,392,312 | 7/1968 | Carman | 106/47 R |
| 3,622,523 | 11/1971 | Amin | 252/514 |
| 3,652,302 | 3/1972 | Levand et al. | 106/47 R |
| 3,682,840 | 8/1972 | Van Loan | 427/101 |

*Primary Examiner*—Michael F. Esposito
*Attorney, Agent, or Firm*—Lawrence Rosen; E. Janet Berry

[57] ABSTRACT

Process for forming a vitreous enamel electrical resistor coating on a substrate, said vitreous enamel containing an electrically conductive species as a crystalline phase and having a temperature coefficient of resistance, as measured in the temperature range of 20° to 120° C, of from −500 to +500 ppm/° C, comprises applying to said substrate a paste comprising (1) an organic medium, (2) a powdered aluminoborate glass containing dissolved molybdenum trioxide, tungsten trioxide, cerium dioxide, manganese dioxide or ferric oxide in an amount of 2 to 30 mol percent of the total constituent oxides of the glass and (3) powdered boron, silicon, molybdenum disilicide or tungsten disilicide in an amount of 0.25 to 30 percent by weight based on the total weight of components (2) and (3) and firing the paste on the substrate at a temperature of about 600° to 900° C to form a vitreous enamel. The coated substrates are particularly useful in thick film printed and fired circuits.

8 Claims, No Drawings

ELECTRICAL RESISTANCE COMPOSITIONS

This application is a continuation-in-part of my copending application Ser. No. 249,804, filed May 3, 1972, now abandoned.

This invention relates to a novel process for forming vitreous enamel resistor coatings on substrates; the compositions used in the process are also novel as are the products. Whilst the resistor coatings may be used in a variety of circumstances they are especially valuable in thick film printed and fired circuits. They are also very useful as fixed resistors in which case the substrate is usually a ceramic tube or rod.

The necessary electrical conductivity of vitreous enamels for use as resistors in thick film printed and fired circuits has previously been derived by including in the compositions, before firing to give the vitreous enamels, various known electrically conductive materials, e.g. noble metals and their oxides. Products made in this way have had the disadvantage, amongst others, of being very costly as a consequence of the need to use very finely divided precious metals or their oxides.

My main object in making the present invention has been to devise a process for forming vitreous enamel electrical resistor coatings on substrates whereby products of desirable properties can conveniently be made and without the need to use finely divided precious metals or their oxides.

In accordance with the present invention vitreous enamel electrical resistors of desirable properties can be formed as coatings on substrates by a convenient process not necessarily involving the use of compositions containing any electrically conductive materials. Thus, according to the invention a process for forming a vitreous enamel electrical resistor coating on a substrate, said vitreous enamel containing an electrically conductive species as a crystalline phase and having a temperature coefficient of resistance, as measured in the temperature range from 20° to 120° C, of from −500 to +500 ppm/° C, comprises applying to a substrate a paste which comprises (1) an organic medium, (2) a powdered aluminoborate glass, containing as a dissolved component, a metal oxide selected from the group consisting of molybdenum trioxide, tungsten trioxide, cerium dioxide, manganese dioxide and ferric oxide in an amount of 2 to 30 mol percent based on the total amount of glass expressed as its component oxides and (3) a powdered reducing agent capable of withstanding glass firing temperatures selected from the group consisting of boron, silicon, molybdenum disilicide and tungsten disilicide in an amount of 0.25 to 30 percent by weight based on the total weight of glass and reducing agent and firing said paste on said substrate at a temperature of about 600° to 900° C to form a vitreous enamel.

The process is effective by virtue of the firing causing the reducing agent to reduce the metal oxide dissolved in the aluminoborate glass to an electrically conductive species which forms a crystalline phase in the resultant vitreous enamel. The particular reducing agents are effective since they are capable of withstanding glass firing temperatures e.g. about 600° to 900° C and are able to reduce the particular metal oxides at these temperatures to give electrically conductive species as a crystalline phase in the vitreous enamel. Thus, the particular reducing agents are sufficiently oxidation-resistant that some at least will survide up to the point when the glass fuses and then be able to effect the reduction.

The firing is normally effected in air and the maximum firing temperature is preferably from 700° to 800° C.

The electrically conductive species formed by the firing may be the metal corresponding to the metal oxide dissolved in the aluminoborate glass or a lower oxide of themetal e.g. molybdenum dioxide.

All the particular metal oxides can be reduced by the reducing agents under the conditions of the process to yield electrically conductive species that form a crystalline phase in the vitreous enamel formed by the firing. the preferred metal oxides are molybdenum trioxide and tungsten trioxide.

It is generally desirable that the vitreous enamel should have a sheet resistivity of not more than 5MΩ/square for a thickness of 0.002 cm. at 20° C and such products can readily be obtained as long as a sufficient amount of the metal oxide is present dissolved in the aluminoborate glass. In practice I have found that products of desirable properties are formed if the dissolved metal oxide is present in the aluminoborate glass in an amount of 2 to 30 mol percent of the total constituent oxides of the glass.

It is common to express glass compositions in terms of the relative mol percentages of the metallic and non metallic oxides that may be regarded as constituting the glass since these relative mol percentages are generally more significant to the properties of the glass than are the corresponding weight percentages. Sometimes the proportion of an oxide component of a glass is simply expressed as a mol percentage of the glass and this corresponds exactly to expressing the mol percentage of the oxide component in terms of the total mol amount of all the oxides constituting the glass. Accordingly, as an example, the constituent oxides of a simple cadmium aluminoborate glass are cadmium oxide, boric oxide and aluminum oxide and these might be present in a molar ratio of 35:50-15. Thus, in this specific glass the cadmium oxide content is 35 mol percent based on the total amount of glass expressed as its constituent oxides or, more briefly, 35 mol percent based on the glass. If such a glass were modified by inclusion of 10 mol percent of dissolved molybdenum trioxide, then the mol percentages of cadmium oxide, boric oxide and aluminum oxide in the modified glass would be correspondingly depressed below, 35, 50 and 15 mol percent respectively.

Glasses can be analysed to determine the weight ratios of the oxide-forming metallic and non-metallic elements and thus the mol percentages of the constituents oxides can be determined.

I have found that compositions generally of the type now in question but that do not give rise to the phase separation in the fired products i.e. the formation of an electrically conductive species as a crystalline phase in the vitreous enamel, also fail to give products of use in thick film printed and fired circuits. Thus, whilst the desired phase separation can be achieved with compositions containing any of the particular reducing agents and an aluminoborate glass in which is dissolved any of the particular metal oxides, I have found that, for example, a composition containing molybdenum trioxide dissolved in a particular lead borosilicate glass and boron as reducing agent does not give the desired phase separation even though the necessary reduction of the molybdenum trioxide occurs. Whether or not the desired phase separation has occurred can readily be determined by experiment.

The process according to the invention enables vitreous enamel resistor coatings to be made having a temperature coefficient of resistance (TCR), as measured in the temperature range of 20° to 120° C, of from −500 to +500 ppm/° C and this range is very suitable if the resistor-coated substrates are to be used in thick film printed and fired circuits.

The electrical properties of the fired products depend on various factors but compositions which give rise to such products having desirable electrical properties can easily be formulated. The experimentation needed to determine the electrical properties of the fired products can easily be performed. The amount and nature of the reducing agent influences the electrical properties. The reducing agent is present in the compositions in an amount of 0.25 to 30 percent by weight based on the total weight of the glass and the reducing agent. Since the metal oxide e.g. molybdenum trioxide is actually dissolved in the aluminoborate glass it is a part of the glass that is used and thus the above reference to the weight of the glass signifies the weight of the basic aluminoborate glass plus the weight of the dissolved metal oxide.

In the case of boron and silicon as reducing agents the amount is usually less than 10 percent by weight. Naturally sufficient reducing agent must be present to reduce some or all of the metal oxide to a conductive species. However, if too much reducing agent is used unsatisfactory electrical properties may result. For example, a composition in which the glass was a cadmium aluminoborate glass containing dissolved molybdenum trioxide gave a TCR value which was more negative than really desirable when 1.3 percent by weight of boron was used as reducing agent but was satisfactory when 0.75 percent by weight of boron was used.

The nature of the glass also affects the electrical properties. However, I have found that aluminoborate glasses are suitable. Examples of such glasses are cadmium aluminoborate; lead, cadmium aluminoborate and sodium, zinc aluminoborate. For a given glass system e.g. cadmium aluminoborate, I have found that the TCR value varies systematically with the composition of the glass. Accordingly, with all other variables fixed, the most satisfactory TCR value can be obtained by selecting a particular glass composition within the glass system.

The electrical properties are also influenced by the amount of metal oxide dissolved in the glass. In a given system the electrical properties depend on which metal oxide is used. As already mentioned, suitable amounts of dissolved metal oxides are 2 to 30 mol percent.

Apart from the nature of the compositions, the electrical properties of the fired products also depend on the maximum firing temperature used. In any given case resistivity will be minimised at a particular firing temperature, this usually being the preferred firing temperature, and higher or lower temperatures will give rise to higher resistivity. TCR values are generally made more negative by use of lower maximum firing temperatures.

In order to render the compositions conveniently applicable to a substrate the powdered components are made into a paste with an organic medium. Suitable organic media for formulating printing pastes which are to be applied to a substrate and then fired to give a vitreous enamel resistor coating are well known. The organic media are liquid but may contain solids in solution or suspension. One example of a suitable organic medium is ethyl cellulose in terpineol.

The composition including the organic medium is applied to the substrate e.g. by printing and, optionally after drying the applied coating, the composition is fired, usually in air. The organic medium is used solely to make the composition conveniently applicable to a substrate and indeed the organic medium if not entirely removed by drying before the firing is removed during firing by evaporation and/or pyrolysis. The composition including the organic medium may be formulated in conventional manner so as to be suitable for the chosen manner of application e.g. printing.

The substrate may be any conventional electrically insulating substrate capable of withstanding glass firing temperatures and substrates may be used that are conventional in the art of providing vitreous enamel electrical resistor coatings on substrates. Conventional substrates are of ceramic materials such as ceramic alumina, ceramic beryllia, steatite and hard porcelain. Such substrates are described in a variety of publications, ceramic alumina, for example, being described in British patent specification No. 1,036,808. Other types of substrates that may be used include substrates of high temperature-resistant glasses.

The thickenss of the vitreous enamel coating may vary depending on the particular purpose for which the coated substrate is required and, in the case of thick film printed and fired circuits, the thickness may be conventional. Commonly the thickness of the vitreous enamel on the substrate will be from 0.5 to 2 mils.

In carrying out the process the firing is normally effected for a period of 15 minutes up to 2 hours e.g. 30 or 45 minutes or 1 hour.

The invention is illustrated by the examples in the following Table. In each case the powdered components were made into a paste with 5 percent w/v ethyl cellulose in terpineol before firing. The compositions in the Table were suitable for making resistors for use in thick film printed and fired circuits. The substrate used was of ceramic alumina.

| | | | | | | |
|---|---|---|---|---|---|---|
| Cadmium aluminoborate | 10 | Boron 0.75 | 760 | 45 | 114K | −124 |
| | $MoO_3$ | Silicon 2.3 | 770 | 45 | 11.6K | +190 |
| | | Molybdenum disilicide 8.1 | 770 | 70 | 75 | +350 |
| | 5 | Tungsten disilicide 22.0 | 770 | 70 | 1.9K | −410 |
| | $MoO_3$ | | | | | |
| Lead cadmium aluminoborate | 10 $MoO_3$ | Boron 1.25 | 760 | 45 | 1.0K | −10 |
| Cadmium aluminoborate | 10 $WO_3$ | Boron 7.03 | 760 | 45 | 16K | +80 |
| Sodium zinc aluminoborate | 10 $WO_3$ | Boron 7.3 | 760 | 45 | 60K | −400 |

The following example demonstrates the dependence of TCR values on the particular glass when all other variable are fixed.

A powdered cadmium aluminoborate glass was formed having 10 mol percent of dissolved molybdenum trioxide. The molar ratio of cadmium oxide to boric oxide to aluminum oxide in the glass was 35:5:15. The powdered glass was mixed with 1% by weight of boron powder, made into a paste as described above and fired for 45 minutes in air, the maximum firing temperature being 760° C. The product has a sheet resistivity of 10 KΩ/square for a thickness of 0.002 cm. and the TCR value was −500 ppm/° C. The substrate used was of ceramic alumina.

The above procedure was repeated with the sole exception that the molar ratio of cadmium oxide to boric oxide to aluminum oxide was 25:65:10. In this case the sheet resistivity of the fired product was again 10 KΩ/square for a thickness of 0.002 cm. but the TCR value was +100 ppm/° C

What is claimed is:

1. A process for forming a vitreous enamel electrical resistor coating on a substrate, said vitreous enamel containing an electrically conductive species as a crystalline phase and having a temperature coefficient of resistance, as measured in the temperature range of 20° to 120° C., of from −500 to +500 ppm/° C., comprising applying to a substrate a composition which comprises (1) a liquid organic medium, (2) a powdered aluminoborate glass, containing as a dissolved component, a metal oxide selected from the group consisting of molybdenum trioxide, tungsten troixide, cerium dioxide, manganese dioxide and ferric oxide in an amount of 2 to 30 mol percent based on the total amount of glass expressed as its component oxides and (3) a powdered reducing agent capable of withstanding glass firing temperature selected from the group consisting of boron, and silicon, in an amount of 0.25 to 30 percent by weight based on the total weight of glass and reducing agent, the relative proportions of (1), (2) and (3) being such that said compositions is a paste, and firing said paste on said substrate at a temperature of about 600° to 900° C. to form a vitreous enamel.

2. A process according to claim 1 in which the aluminoborate glass is a cadmium aluminoborate glass containing dissolved molybdenum trioxide.

3. A process according to claim 2 in which the reducing agent is boron.

4. A process according to claim 2 in which the reducing agent is silicon.

5. A process according to claim 1 in which the aluminoborate glass is a lead, cadmium aluminoborate glass containing dissolved molybdenum trioxide and the reducing agent is boron.

6. A process according to claim 1 in which the aluminoborate glass is a cadmium aluminoborate glass containing dissolved tungsten trioxide and the reducing agent is boron.

7. A process according to claim 1 in which the aluminoborate glass is a sodium, zinc aluminoborate glass containing dissolved tungsten trioxide and the reducing agent is boron.

8. A process according to claim 1 wherein the reducing agent is employed in an amount of less than 10% by weight.

* * * * *